United States Patent [19]

Padgitt

[11] 4,089,316

[45] May 16, 1978

[54] ADJUSTABLE ROTARY POSITION SENSOR FOR ELECTRONIC SPARK TIMING CONTROL

[75] Inventor: Kenneth Warren Padgitt, Arlington Heights, Ill.

[73] Assignee: Motorola, Inc., Schaumburg, Ill.

[21] Appl. No.: 673,501

[22] Filed: Apr. 5, 1976

[51] Int. Cl.[2] ..... F02P 1/00

[52] U.S. Cl. ..... 123/146.5 A; 324/16 T; 338/32 H

[58] Field of Search ..... 123/146.5 A, 148 E; 324/16 T, 34 PS, 34 D, 45, 173; 310/DIG. 3, 168; 338/32 R, 32 H

[56] References Cited

U.S. PATENT DOCUMENTS

| | | | |
|---|---|---|---|
| 2,263,859 | 11/1941 | Eldredge | 324/16 T |
| 3,198,973 | 8/1965 | Short | 310/168 |
| 3,575,150 | 4/1971 | Habert | 123/146.5 A |
| 3,776,206 | 12/1973 | Hunt | 123/146.5 A |
| 3,861,225 | 1/1975 | Mattson | 123/146.5 A |
| 3,883,795 | 5/1975 | Klein | 324/16 T |
| 3,906,920 | 9/1975 | Hemphill | 123/146.5 A |
| 3,939,397 | 2/1976 | Maisonville | 324/16 T |

FOREIGN PATENT DOCUMENTS

| | | | |
|---|---|---|---|
| 1,400,614 | 7/1972 | United Kingdom | 324/173 |

*Primary Examiner*—Charles J. Myhre
*Assistant Examiner*—Jeffrey L. Yates
*Attorney, Agent, or Firm*—James W. Gillman; Phillip H. Melamed

[57] ABSTRACT

An improved adjustable rotary position sensor assembly is disclosed which is adaptable for sensing the rotational position of a body being synchronously rotated by an engine crankshaft and producing spark timing signals for the engine in response to the rotational position of the body. A generally cylindrically shaped Hall sensor probe is mounted through a cylindrical bore in an engine block and positioned such that one end of the sensor probe will be adjacent to radially extending portions of the rotary body during the rotation of the body by the engine. The Hall probe is rotatably adjustable with respect to the central axis of its cylindrically shaped body. A slotted mounting flange is attached to one end of the Hall probe and together with a retaining screw provides for locking the probe into a fixed rotational position with respect to its central axis after it has been adjusted. The Hall probe has an active sensing area located at one end of the probe for sensing when the rotary body has an extending portion directly adjacent to the active sensing area. The active sensing area is disposed substantially away from the central axis of rotation of the Hall probe and this enables the rotational position of the active sensing area, with respect to the axis of rotation of the rotary body, to be adjusted by rotating the Hall probe in its cylindrical bore with respect to its central axis of rotation. Thus a simplified mechanically adjustable rotary position sensor assembly has been provided which is adaptable for use in an electronic spark timing ignition system.

21 Claims, 3 Drawing Figures

ADJUSTABLE ROTARY POSITION SENSOR FOR ELECTRONIC SPARK TIMING CONTROL

BACKGROUND OF THE INVENTION

The present invention relates generally to the field of adjustable rotational position sensors and more particularly to an improved mechanically adjustable sensor assembly which provides spark timing signals for the ignition system of an engine.

Mechanical and electronic ignition systems for internal combustion engines are commonly known to those of average skill in the art. Both of these systems require the sensing of the rotational position of the crankshaft of the engine so that the cylinder spark ignitions will occur when the cylinders are at desired positions during their compression cycles. Prior mechanical ignition systems use a cam which is synchronously rotated by the engine crankshaft and which sequentially delivers a spark signal, through a set of contact points opened and closed by the cam, to contacts which are located at adjustable rotational positions with respect to the axis of rotation of the cam. Commonly, the rotational position of a distributor housing carrying the points and contacts is varied in order to provide for adjusting the occurrence of the spark timing ignition signals with respect to the rotation of the cam. In electronic ignition systems, a rotary body having projections is synchronously rotated by the crankshaft of the engine. The rotational position of this rotary body is then sensed by a variety of sensor devices including photosensitive transistors, magnetic pick-up sensors and Hall sensors. Hall sensors are known to those of average skill in the art and comprise a probe having an active sensor area which develops a signal in response to the presence of a metallic material adjacent to the active sensor area.

In some prior electronic ignition systems, the rotational position of the active sensor area with respect to the axis of rotation of the rotary body is fixed. Adjusting the occurrence of the spark timing signal with respect to the rotational position of the rotary body is then accomplished by either an electronic adjustment in the circuitry processing the Hall sensor signal or a mechanical adjustment which involves rotating the rotational position of the rotary body with respect to the rotational position of the crankshaft of the engine. In the first case, additional electronic circuitry is required to perform the adjustment while in the second case access to the rotary body and additional mechanical structure providing for its rotational adjustment must be provided. In addition, adjustment of the rotary body with respect to the crankshaft would be impractical where the rotary body is located within the block of the internal combustion engine. An alternative solution for providing a rotational position adjustment would be to mount the sensor probe so that its rotational position with respect to the axis of the rotary body would be adjustable. This would be analagous to the mechanical ignition system in which the distributor housing is mechanically rotated to provide an adjustment. Such an alternative solution would also require complex additional mechanical mounting structures for the sensor and would be totally impractical for ignition systems in which the sensor is to be mounted through or within the engine block.

SUMMARY OF THE INVENTION

An object of the present invention is to provide an improved adjustable sensor which is adaptable for sensing the rotational position of a rotary body.

A more particular object of the present invention is to provide an improved and simplified adjustable rotary position sensor assembly which overcomes the aforementioned deficiencies of the prior art sensor assemblies.

A further object of the invention is to provide an improved spark timing ignition system for an engine which has a simplified mechanical spark timing adjustment.

An improved adjustable rotary position sensor assembly is provided. The assembly comprises a rotary body rotatable about a first axis, a sensor having a body with first and second ends and an active sensor area positioned at one of said first and second ends for sensing the rotational position of the rotary body, and mounting structure for positioning the sensor with respect to the rotary body. The mounting structure includes a body with a cylindrical bore having a central axis and provides for adjustably positioning the sensor body within the cylindrical bore. The positional adjustment of the sensor body within the bore changes the rotational position of the active sensor area with respect to the axis of rotation of the rotary body.

A specific improved adjustable rotary position sensor assembly is also disclosed. This assembly comprises a rotary body rotatable about a first axis, a sensor having a body with first and second ends and an active sensor area positioned at one of said first and second ends for sensing the rotational position of the rotary body, and mounting structure for positioning the sensor with respect to the rotary body. The mounting structure provides for the rotational position adjustment of the sensor body about a second axis which is different from the first axis and the active sensor area is disposed at the one end of the sensor body at a distance substantially away from the second axis of rotation. The above structural limitations result in the rotation of the sensor body about the second axis causing a rotation of the active sensor area relative to the first axis. Thus by providing for the rotational adjustment of the sensor body about the second axis and locating the active sensor area at a distance substantially away from this axis, an adjustment in the position of the active sensor area with respect to the first axis of rotation is obtained.

In a preferred embodiment of the above sensor assembly, the amount of possible rotation of the sensor body about the second axis is limited to no more than 180° to eliminate any ambiguity and provide for one to one correspondence of the rotational position of the sensor body with respect to the second axis and the rotational position of the active sensor area with respect to the first axis. Additionally, the thickness of the rotary body in a direction parallel to the plane of movement of the active sensor area about the second axis is at least as great as the distance between the active sensor area and the second axis. This insures that a portion of the rotary body will always pass adjacent to the active sensor area regardless of the rotational position of the sensor with respect to the second axis.

The improved rotary position sensor assembly is illustrated as forming part of an electronic spark timing ignition system for an internal combustion engine of a car. The sensor assembly is illustrated as being mounted in a cylindrical bore in the engine block. Mechanical structure is provided for rotating the sensor within the cylindrical bore and thereby affecting a change in the rotational position of the active sensor area with respect to the axis of rotation of a rotary body being synchronously driven by the engine crankshaft.

BRIEF DESCRIPTION OF THE DRAWINGS

For a more complete understanding of the invention reference should be made to the drawings, in which.

DESCRIPTION OF THE PREFERRED EMBODIMENT

Figure 1:
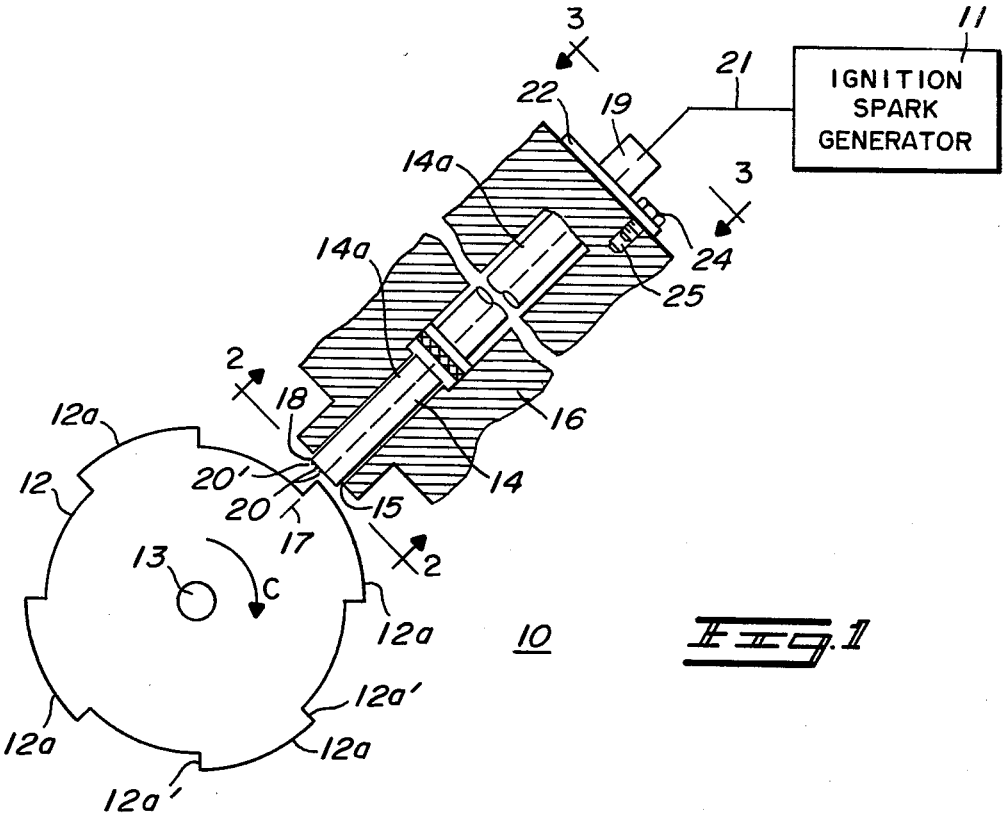
FIG. 1 is a combined block diagram and planar and partial cross sectional view of an ignition system using an improved adjustable rotary position sensor assembly.

FIG. 1 illustrates an ignition system 10 for an internal combustion engine (not shown). The ignition system basically comprises an ignition spark generator 11 (shown in block form), a metallic rotary body 12 which is synchronously rotated about an axis 13 by the crankshaft of the engine, and a Hall probe sensor 14 which is mounted through a cylindrical bore 15 in an engine block 16 (shown in cross section). Since the rotary body 12 is synchronously rotated by the engine crankshaft, its rotational position is related to the rotational position of the crankshaft and therefore related to the cycle position of each of the cylinders of the engine. The Hall probe 14 generally senses the rotational position of the rotary body 12 and produces an output signal which is coupled to the ignition spark generator 11 and results in the occurrence of an ignition spark signal being delivered to an engine cylinder at a desired cycle position of the cylinder.

The ignition spark generator 11 merely represents the standard ignition electronics which receive the information about the rotational position of the engine crankshaft and process this information to create a cylinder spark ignition. Thus the ignition spark generator 11 is well known to those of average skill in the art and comprises structure similar to that present in any electronic or mechanical ignition system. A suitable ignition system which receives rotational position information from a magnetic pick-up sensor is illustrated in U.S. Pat. No. 3,933,141 to Philip Gunderson which is entitled "Zero Crossing Circuit For Electronic Ignition System" and is assigned to the same assignee as the present invention. Thus the contents of the ignition spark generator 11 are well known and therefore will not be discussed further.

The Hall probe 14 has a generally cylindrically shaped body **14*a* which is formed about a central axis 17. The body 14*a* has a first end 18 and a second end 19 which protrude from each end of the cylindrical bore 15, the end 18 being generally disposed adjacent to the rotary body 12 and the end 19 being generally disposed away from the rotary body 12**.

Figure 2:
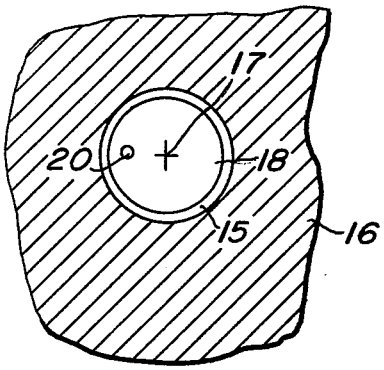
FIG. 2 is a planar end view of the rotary position assembly in FIG. 1 taken along lines 2—2.
Figure 3:
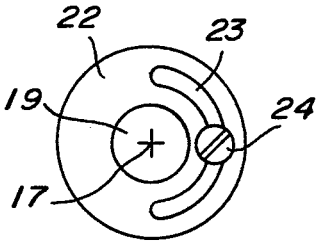
FIG. 3 is a planar end view of the sensor assembly in FIG. 1 taken along lines 3—3.

An active sensing area 20 is eccentrically positioned at the first end 18, i.e. the area 20 is disposed substantially away from the central axis 17. This is most clearly illustrated in FIG. 2. The probe 14 is positioned such that the active sensing area 20 will alternately be adjacent to radially extending portions **12*a* of the rotary body 12 as the body is rotated about the axis 13 in the direction indicated by an arrow C in FIG. 1. The active sensing area 20 senses the presence of a metallic body adjacent to it and produces a control signal which is coupled to the ignition spark generator 11 by an electrical connection 21 emanating from the probe end 19. By sensing when the radially extending portions 12*a* are adjacent to the active sensing area 20 during the rotation of the rotary body 13, the probe 14 provides rotational position information to the ignition spark generator 11. The rotational positions of the body 12 which correspond to when edges 12*a*′ of a radially extending portion 12*a* are directly adjacent to the active sensor area 20 correspond to precise engine cylinder cycle positions. This information is subsequently processed by circuitry in the generator 11** and results in the creation of a cylinder spark at the proper position of the cylinder cycle.

A circular mounting flange 22 is attached to the probe body **14*a* and is located outside of the cylindrical bore 15 and generally adjacent to the end 19. The mounting flange 22 has a diameter greater than the diameter of the cylindrical bore and has a slot 23 which arcuately extends half way around the axis 17. A retaining screw 24 has a head diameter larger than the width of the slot 23 and passes through the slot into a threaded hole 25 in the engine block 16. The mounting flange 22 and the retaining screw 24 provide for locking the rotational position of the probe 14 with respect to the axis 17** after this position has been satisfactorily adjusted.

The mounting flange 22, the slot 23, the retaining screw 24 and the engine block 16 and its cylindrical bore 15 generally form a mounting means for positioning the probe 14 in a proper position with respect to the rotary body 12. Initially, the mounting structure provides for positioning the active sensing area 20 such that it will be adjacent to the extending portions **12*a* at specific rotational positions of the rotary body 12 with respect to the axis of rotation 13**.

If the initial positioning of the probe 14 produces control signals for the ignition spark generator 11 which result in ignition sparks occurring at the wrong cylinder cycle positions, adjustment is accomplished as follows. The retaining screw 24 is loosened and the mounting flange 22 is rotated with respect to the central axis 17 of the probe which also corresponds to the central axis of the cylindrical bore 15. This results in adjusting the rotational position of the active sensing area 20 with respect to the central axis 17. This in turn results in moving the active sensing area 20 to a new rotational position 20′, illustrated in FIG. 1, with respect to the axis of rotation 13 of the rotary body 12. Thus, a rotational adjustment of the sensor body 14 with respect to its own central axis 17 has caused a change in the rotational position of the active sensor area 20 with respect to the axis of rotation 13 of the rotary body 12. This change of position of the active sensor area 20 results in changing the rotational position of the body 12 which corresponds to when the edges **12*a*′ will be adjacent to the active sensor area 20**. This in turn alters the occurrence of the signal produced by the Hall sensor and provides a simple mechanical adjustment for obtaining a desired advance or retard of the engine spark timing. The rotary position sensor assembly described is ideally suited for the use of a Hall sensor probe which is to be mounted through a cylindrical bore in an engine block.

In a preferred embodiment of the present invention, the slot 23 extends at most half way (180°) about the central axis 17. This will eliminate any ambiguity in the correspondence of rotational position of the active area 20 with respect to axis 13 and the rotational position of the mounting flange 22 with respect to axis 17. Thus the mounting means includes structure for preventing more than 180° of rotation of the sensor probe 14 about the central axis 17 so that a one to one correspondence exists between the sensor 14 rotation about axis 17 and the active area 20 rotation about the axis 13.

Additionally, the thickness of the rotary body 12 in the direction which is parallel to the axis 13 and parallel to the plane of movement of the active sensor area 20 about axis 17 should be at least as great as the distance between said active sensor area 20 and the axis 17. This limitation is required since the active sensing area 20 should always be positioned such that the rotation of the rotary body 12 will cause the extending portions 12*a* to be located adjacent to the active sensing area 20 during the rotation of the body 12.

When a rotary body having a nominal 4 inches diameter is used with a Hall probe having an active sensing area to central axis dimension of ⅛ inches, the preceding embodiment of the present invention will provide approximately 7° of mechanical rotational position adjustment of the active sensing area about the axis of rotation of the rotary body. This amount of angular adjustment is generally satisfactory for a typical ignition system.

While the present invention has been illustrated with respect to a Hall sensor probe and radially extending rotary body projections, the present invention is not limited to such structures. The present invention in equally applicable to other types of sensors such as magnetic pickup devices and photosensitive transistors. One basic concept of the present invention involves the locating of the active sensor area at the distance which is substantially away from the axis about which the sensor probe is to be rotated. Another basic concept involves locating an active sensor area at one end of a sensor body which is adjustably positionable within a cylindrical bore.

While I have shown and described specific embodiments of this invention, further modifications and improvements will occur to those skilled in the art. All such modifications which retain the basic underlying principles disclosed and claimed herein are within the scope of this invention.

I claim:

1. An improved adjustable position sensor assembly comprising:

a rotary body rotatable about a first axis;

at least one sensor means having a body with first and second ends and an active sensor area positioned at one of said first and second ends, said active sensor area sensing the rotational position of said rotary body about said first axis; and mounting means for positioning said sensor means with respect to said rotary body, said mounting means providing for the rotational position adjustment of said sensor body by rotating said sensor body about a second axis different from said first axis and said active sensor area being disposed at said one end of said sensor body at a distance substantially away from said second axis of rotation, said sensor body being generally cylindrical in shape and said second axis corresponding to the central axis of said cylindrically shaped sensor body, whereby rotation of said sensor body about said second axis results in adjusting the rotational position of said active sensor area relative to said first axis.

2. An improved adjustable position sensor assembly according to claim 1 wherein said second axis is substantially perpendicular to said first axis.

3. An improved adjustable rotary position sensor assembly according to claim 1 wherein said mounting means includes a structure having a cylindrical bore into which a portion of said sensor body fits, the central axis of said cylindrical bore also corresponding to said second axis.

4. An improved adjustable rotary position sensor assembly according to claim 3 wherein said mounting means includes a mounting flange attached to said sensor body and having a mounting slot which is arcuately disposed about said second axis, said mounting means incuding a retaining means which cooperates with said slot for maintaining said sensor in a fixed rotational position with respect to said second axis after the adjustment of this rotational position.

5. An improved adjustable rotary position sensor assembly according to claim 4 wherein said slot effectively extends at most half way around said second axis.

6. An improved adjustable rotary position sensor assembly according to claim 3 wherein said mounting means includes structure for preventing more than 180° of rotation of said sensory body about said second axis.

7. An improved adjustable rotary position sensor assembly according to claim 6 wherein said sensor comprises a Hall sensor.

8. An improved adjustable rotary position sensor assembly according to claim 7 wherein said rotary body has at least one extending portion which is positioned adjacent to said Hall sensor during the rotation of said rotary body.

9. An improved adjustable rotary position sensor assembly according to claim 8 wherein said extending portion is radially extending outward from said first axis.

10. An impoved adjustable rotary position sensor assembly according to claim 8 wherein said extending portion of said rotary body has a fixed width dimension in a direction parallel to the plane of movement of said active sensor area about said second axis which is at least as great as the distance between said active sensor area and said second axis.

11. An improved spark timing ignition system for an engine, comprising;

rotary body means synchronously rotatable about a first axis by an engine crankshaft;

at least one rotary position sensor means having a body with first and second ends and an active sensor area positioned at one of said first and second ends, said active sensor area sensing the rotational position of said rotary body about said first axis;

mounting means for positioning said sensor with respect to said rotary body, said mounting means providing for the rotational position adjustment of said sensor body by rotating said sensor body about a second axis different from said first axis and said active sensor area being disposed at said one end of said sensor body at a distance substantially away from said second axis of rotation; and means coupled to said sensor means for generating spark timing ignition signals in response to the rotational position of said rotary body, said sensor body being generally cylindrical in shape and said second axis corresponding to the central axis of said cylindrically shaped sensor body, whereby the rotation of said sensor about said second axis results in adjusting the rotational position of said active sensor area relative to said first axis and thereby provides an ignition spark timing adjustment for the signals created by said ignition signal generator means.

12. An improved spark timing ignition system according to claim 11 wherein said second axis is substantially perpendicular to said first axis.

13. An improved spark timing ignition system according to claim 11 wherein said mounting means includes a structure having a cylindrical bore into which a portion of said sensor body fits, the central axis of said cylindrical bore also corresponding to said second axis.

14. An improved spark timing ignition system according to claim 13 wherein said mounting means includes a mounting flange attached to said sensor and having a mounting slot which is arcuately disposed about said second axis, said mounting means including a retaining means which cooperates with said slot for maintaining said sensor in a fixed rotational position with respect to said second axis after the adjustment of this rotational position.

15. An improved spark timing ignition system according to claim 14 wherein said slot effectively extends at most half way around said second axis.

16. An improved spark timing ignition system according to claim 13 wherein said mounting means includes a structure for preventing more than 180° of rotation of said sensor body about said second axis.

17. An improved spark timing ignition system according to claim 16 wherein said sensor comprises a Hall sensor.

18. An improved spark timing ignition system according to claim 17 wherein said rotary body has at least one extending portion which is positioned adjacent to said Hall sensor during the rotation of said rotary body.

19. An improved spark timing ignition system according to claim 18 wherein said extending portion is radially extending outward from said first axis.

20. An improved spark timing ignition system according to claim 18 wherein said extending portion of said rotary body has a thickness dimension in a direction parallel to the plane of movement of said active sensor area about said second axis which is at least as great as the distance between said active sensor area and said second axis.

21. An improved spark timing ignition system according to claim 20 wherein said structure having a cylindrical bore is an engine block.

* * * * *